US008284114B2

(12) United States Patent
Lin et al.

(10) Patent No.: US 8,284,114 B2
(45) Date of Patent: Oct. 9, 2012

(54) ANTENNA MODULE AND DESIGN METHOD THEREOF

(75) Inventors: Yi-Cheng Lin, Taipei (TW); Yi-Chia Chen, Taipei (TW); Yi-Fong Lu, Taipei (TW)

(73) Assignee: National Taiwan University, Taipei (TW)

( * ) Notice: Subject to any disclaimer, the term of this patent is extended or adjusted under 35 U.S.C. 154(b) by 499 days.

(21) Appl. No.: 12/553,816

(22) Filed: Sep. 3, 2009

(65) Prior Publication Data

US 2010/0328176 A1 Dec. 30, 2010

(30) Foreign Application Priority Data

Jun. 25, 2009 (TW) ..... 98121311 A

(51) Int. Cl.
*H01Q 19/10* (2006.01)
*H01Q 15/02* (2006.01)
*H01Q 1/38* (2006.01)

(52) U.S. Cl. ..... 343/834; 343/909; 343/700 MS

(58) Field of Classification Search ..... 343/834, 343/700 MS, 909
See application file for complete search history.

(56) References Cited

U.S. PATENT DOCUMENTS 6,061,027 A * 5/2000 Legay et al. ..... 343/700 MS
7,463,213 B2 * 12/2008 Nakano et al. ..... 343/909
7,636,063 B2 * 12/2009 Channabasappa ..... 343/700 MS

* cited by examiner

*Primary Examiner* — Hoang V Nguyen

(57) ABSTRACT

An antenna module is provided. The antenna module includes a reflective superstrate, an antenna substrate, an antenna and a reflective pattern. The antenna is disposed on the antenna substrate. The reflective pattern is formed on the reflective superstrate, wherein a reflection gap is formed between the reflective superstrate and the antenna substrate. The reflective pattern provides a first reflection phase angle, the antenna substrate provides a second reflection phase angle, the first reflection phase angle includes a first determined phase angle $\Delta_1$, the first determined phase angle $\Delta_1$ is not 0°, the first reflection phase angle is about $-(180°-\Delta_1)$, the second reflection phase angle includes a second determined phase angle $\Delta_2$, the second reflection phase angle is about $-(180°-\Delta_2)$, a dimension of the reflection gap is directly proportional to a total predetermined phase angle $\Delta=\Delta_1+\Delta_2$, and the total predetermined phase angle is between 0°~90°.

8 Claims, 5 Drawing Sheets

ANTENNA MODULE AND DESIGN METHOD THEREOF

CROSS REFERENCE TO RELATED APPLICATIONS

This Application claims priority of Taiwan Patent Application No. 098121311, filed on Jun. 25, 2009, the entirety of which is incorporated by reference herein.

BACKGROUND OF THE INVENTION

1. Field of the Invention

The present invention relates to an antenna module, and in particular relates to an antenna module having an Electromagnetic Band Gap cover.

2. Description of the Related Art

FIG. 1*a* shows a conventional antenna module 1, comprising a cover 10, an antenna substrate 20 and an antenna 30. The antenna 30 provides a wireless signal 2. The cover 10 increases reflection times of the wireless signal 2 to increase the energy intensity thereof. The cover 10 has a first reflection phase angle $\Phi_1$, and the antenna substrate 20 has a second reflection phase angle $\Phi_2$. The first reflection phase angle $\Phi_1$ is about −180°. The second reflection phase angle $\Phi_2$ is about −180°. To regulate the reflected wireless signal 2 in phase, a formula (A) is utilized:

$$-\left(\frac{360}{\lambda}d1\times 2\right)+\phi_1+\phi_2=-360\times N \quad \text{(A)}$$

According to the formula (A), a distance d1 between the cover 10 and the antenna substrate 20 is at least equal to half of a wavelength of the wireless signal 2.

FIG. 1*b* shows another conventional antenna module 1', comprising a cover 10, an antenna substrate 20' and an antenna 30. The antenna 30 provides a wireless signal 2. The cover 10 increases reflection times of the wireless signal 2 to increase the energy intensity thereof. The cover 10 has a first reflection phase angle $\Phi_1$, and the antenna substrate 20' has a second reflection phase angle $\Phi_2'$. The first reflection phase angle $\Phi_1$ is about −180°. The second reflection phase angle $\Phi_2'$ is about 0°. To regulate the reflected wireless signal 2 in phase, a distance d2 between the cover 10 and the antenna substrate 20' is at least equal to a quarter of a wavelength of the wireless signal 2.

Conventionally, the distance between the cover 10 and the antenna substrate 20(20') is large, and the volume of the antenna module is thus large.

BRIEF SUMMARY OF THE INVENTION

A detailed description is given in the following embodiments with reference to the accompanying drawings.

An antenna module is provided. The antenna module comprises a reflective superstrate, an antenna substrate, an antenna and a reflective pattern. The antenna is disposed on the antenna substrate. The reflective pattern is formed on the reflective superstrate, wherein a reflection gap is formed between the reflective superstrate and the antenna substrate. The reflective pattern provides a first reflection phase angle, the antenna substrate provides a second reflection phase angle, the first reflection phase angle comprises a first determined phase angle $\Delta_1$, the first determined phase angle $\Delta_1$ is not 0°, the first reflection phase angle is about $-(180°-\Delta_1)$, the second reflection phase angle comprises a second determined phase angle $\Delta_2$, the second reflection phase angle is about $-(180°-\Delta_2)$, a dimension of the reflection gap is directly proportional to a total predetermined phase angle $\Delta=\Delta_1+\Delta_2$, and the total predetermined phase angle is between 0°~90°.

The antenna module of the embodiment provides return loss bandwidth of 23.59%, realized gain of 11.14 dBi and pure polarization. The antenna module of the embodiment is a wide bandwidth, high gain, and high cross polarization isolation antenna module.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
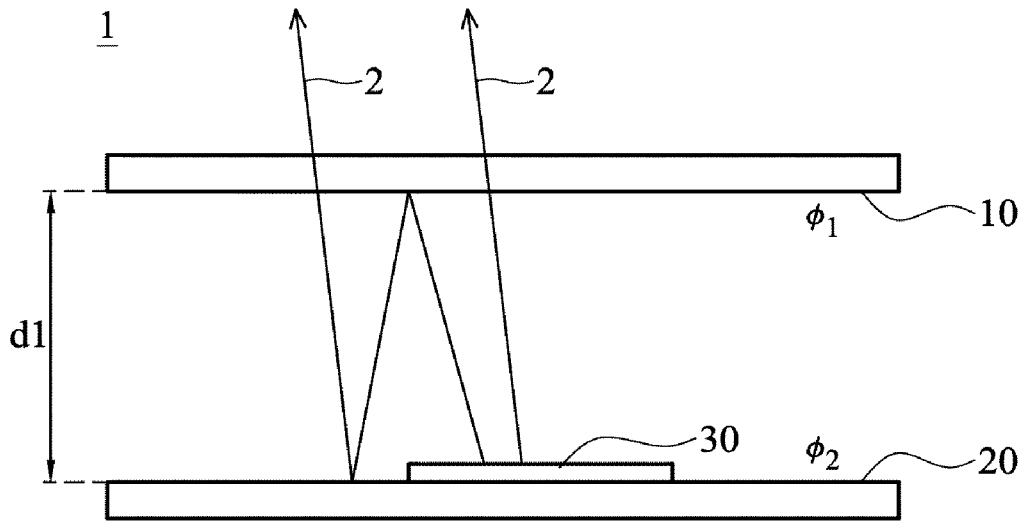
FIG. 1a (PRIOR ART)
FIG. 1*a* shows a conventional antenna module.
Figure 1B:
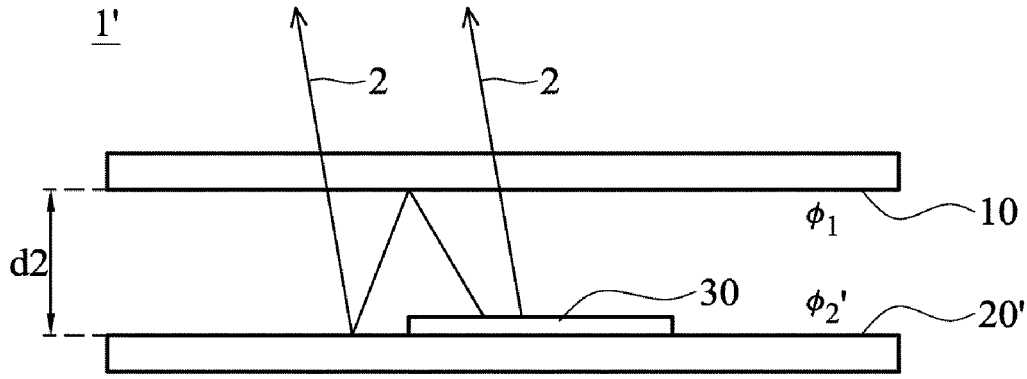
FIG. 1b (PRIOR ART)
FIG. 1*b* shows another conventional antenna module.
Figure 2:
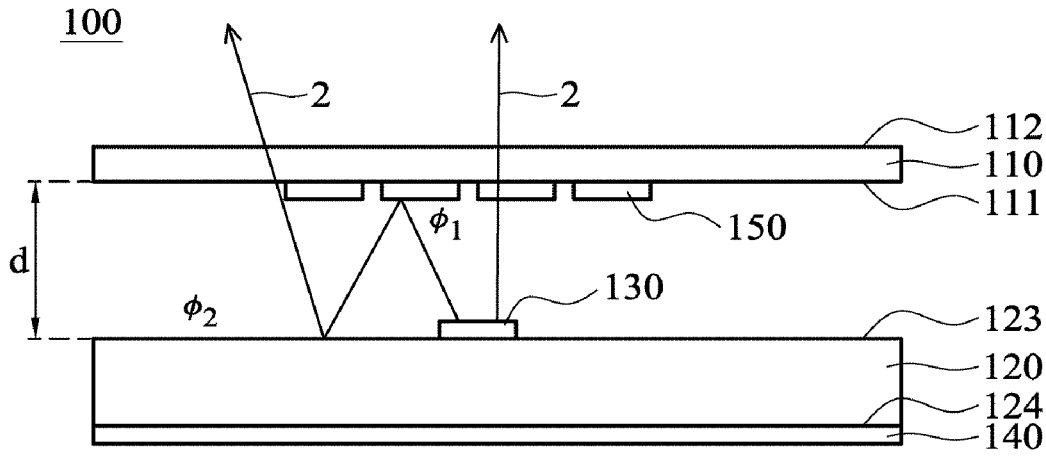
FIG. 2 shows an antenna module of the embodiment of the invention.

FIG. 2 shows an antenna module 100 of the embodiment of the invention, comprising a reflective superstrate 110, an antenna substrate 120, an antenna 130, a ground layer 140 and a reflective pattern 150. The reflective superstrate 110 is a partial reflective superstrate, comprising a first surface 111 and a second surface 112. The first surface 111 is opposite to the second surface 112. The antenna substrate 120 has a third surface 123 and a fourth surface 124. The third surface 123 is opposite to the fourth surface 124. The antenna 130 is disposed on the third surface 123. The ground layer 140 is disposed on the fourth surface 124. The reflective pattern 150 is formed on the first surface 111. The reflective pattern 150 is corresponding to the antenna 130. A reflection gap d is formed between the first surface 111 and the third surface 123. The reflective pattern 150 provides a first reflection phase angle $\Phi_1$, and the third surface provides a second reflection phase angle $\Phi_2$. The first reflection phase angle $\Phi_1$ comprises a first determined phase angle $\Delta_1$. The first determined phase angle $\Delta_1$ is not 0°. The first reflection phase angle $\Phi_1$ is about $-(180°-\Delta_1)$. The second reflection phase angle $\Phi_2$ comprises a second determined phase angle $\Delta_2$. The second reflection phase angle $\Phi_2$ is about $-(180°-\Delta_2)$. A dimension of the reflection gap is directly proportional to a total predetermined phase angle $\Delta=\Delta_1+\Delta_2$, and the total predetermined phase angle is between 0°~90°.

The embodiment designs the first determined phase angle $\Delta_1$ by modifying the reflective pattern 150. The second determined phase angle $\Delta_2$ can be designed by choosing material (dielectric coefficient) and thickness of the antenna substrate 120. According to the Formulas (B1) and (B2):

$$-\left(\frac{360}{\lambda}d\times 2\right)+\phi_1+\phi_2=-360\times 1 \quad \text{(B1)}$$

$$\left(\frac{360}{\lambda}d\times 2\right)=\Delta \quad \text{(B2)}$$

Therefore, the dimension of the reflection gap d is directly proportional to the total predetermined phase angle $\Delta=\Delta_1+\Delta_2$. The total predetermined phase angle $\Delta$ is designed by modifying the first determined phase angle $\Delta_1$ (reflective pattern) and the second determined phase angle $\Delta_2$ (antenna substrate). The reflection gap d can be minimized by modifying the total predetermined phase angle $\Delta$, and the volume of the antenna module 100 is decreased.

The material of the reflective superstrate 110 and the antenna substrate 120 can be dielectric material. The reflection gap d can be an empty space (filled by air), or filled by dielectric material.

In one embodiment of the invention, the total predetermined phase angle $\Delta$ is not 0°. The total predetermined phase angle is between 0°~90°, is preferred between 0°~60°, and is further preferred between 0°~20°.

Figure 3:
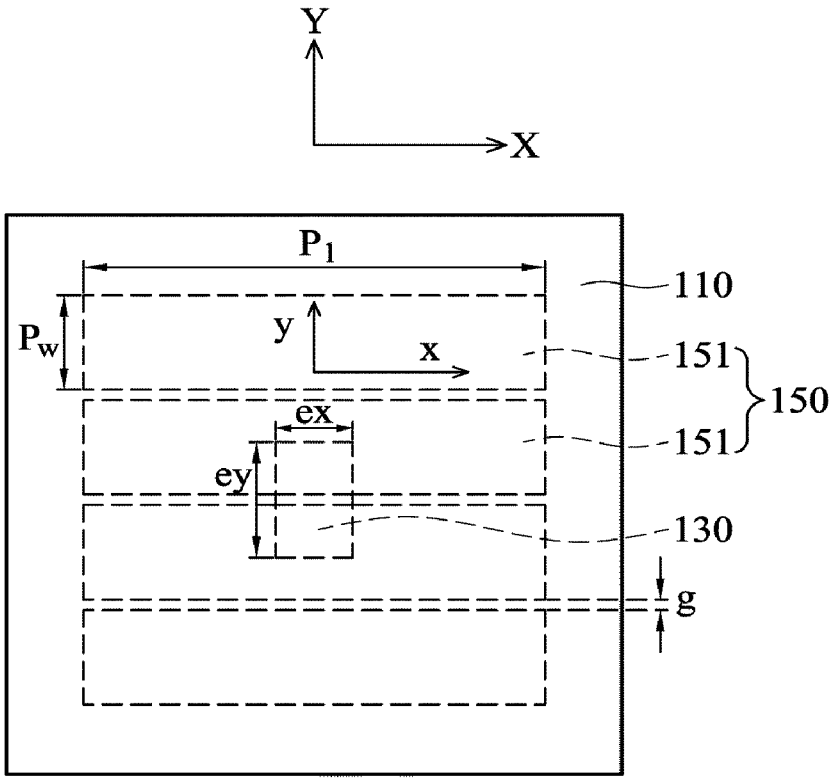
FIG. 3 shows the reflective pattern and the antenna of one embodiment of the invention.

FIG. 3 shows the reflective pattern 150 and the antenna 130 of one embodiment of the invention. The reflective pattern 150 comprises a plurality of reflective units 151. Each reflective unit 151 comprises a major axis x and a minor axis y. The reflective units 151 are equidistantly arranged along a first direction Y, and the minor axes y of the reflective units 151 are parallel to the first direction Y. In this embodiment, the reflective units are rectangular, and the reflective units are arranged into a 4×1 matrix. A unit gap g is formed between contiguous reflective units. The total predetermined phase angle $\Delta$ is about ±20°, a length $P_1$ of the reflective unit 151 is 50 mm, a width $P_w$ of the reflective unit 151 is 11.975 mm, the unit gap g is 0.7 mm, a width ex of the antenna 130 is 8.5 mm, a length ey of the antenna 130 is 14.54 mm, and the reflection gap d is 1 mm.

In the embodiment above, the first determined phase angle $\Delta_1$ can be designed by modifying the length $P_1$ of the reflective unit, the width $P_w$ of the reflective unit, and the unit gap g.

In the embodiment, the antenna 130 is a Patch Antenna, providing a wireless signal 2, wherein the wireless signal comprises a major polarization direction and a cross polarization direction, and the first direction Y is parallel to the major polarization direction.

In the embodiment, the antenna is a Patch Antenna, but the invention is not limited thereto. The antenna can also be a slot antenna or other antenna design.

Figure 4A:
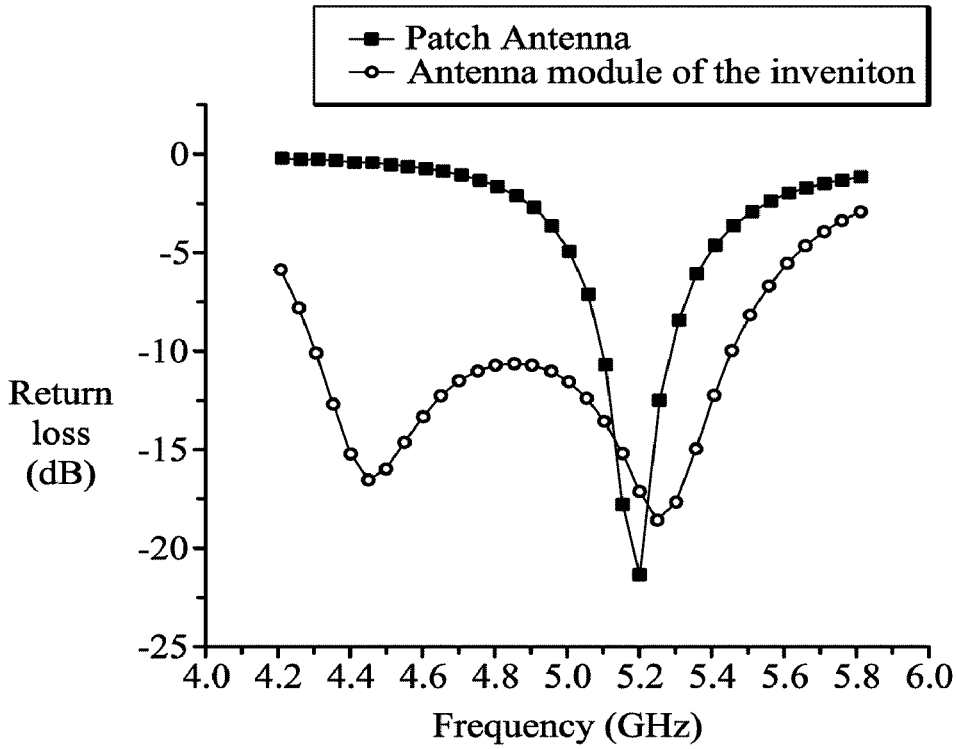
FIG. 4*a* shows the return loss of the antenna module of the embodiment of the invention when compared to a simple Patch Antenna.

FIG. 4*a* shows the return loss of the antenna module 100 of the embodiment of the invention when compared to a simple Patch Antenna. As shown in FIG. 4*a*, the antenna module 100 of the embodiment of the invention has greater bandwidth.

Figure 4B:
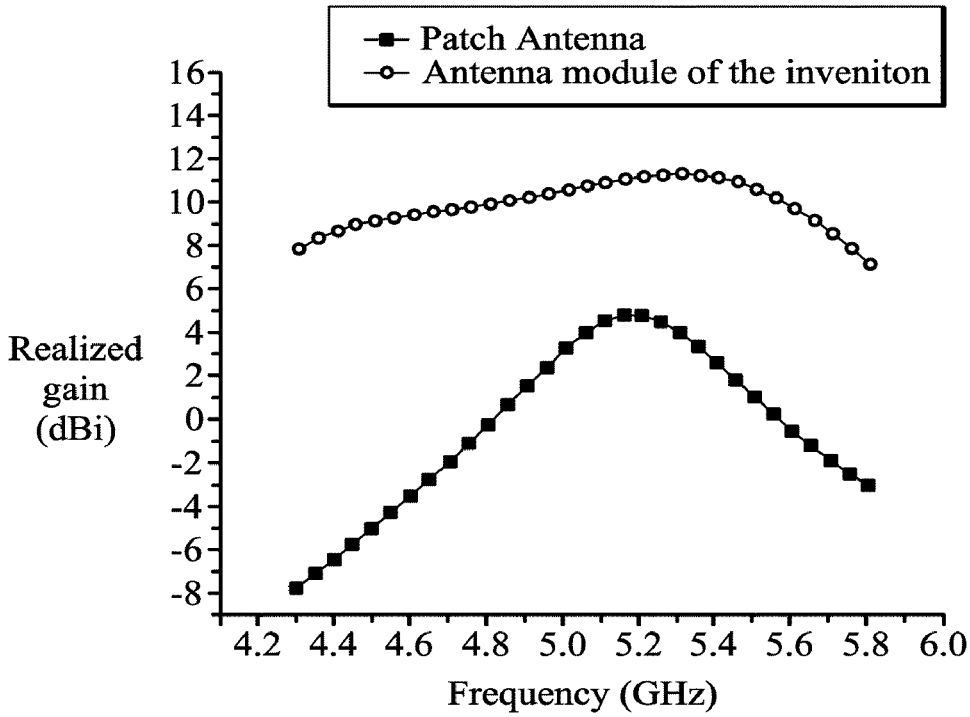
FIG. 4*b* shows the realized gain of the antenna module of the embodiment of the invention when compared to a simple Patch Antenna.

FIG. 4*b* shows the realized gain of the antenna module 100 of the embodiment of the invention when compared to a simple Patch Antenna. As shown in FIG. 4*b*, the antenna module 100 of the embodiment of the invention has increased realized gain.

Figure 4C:
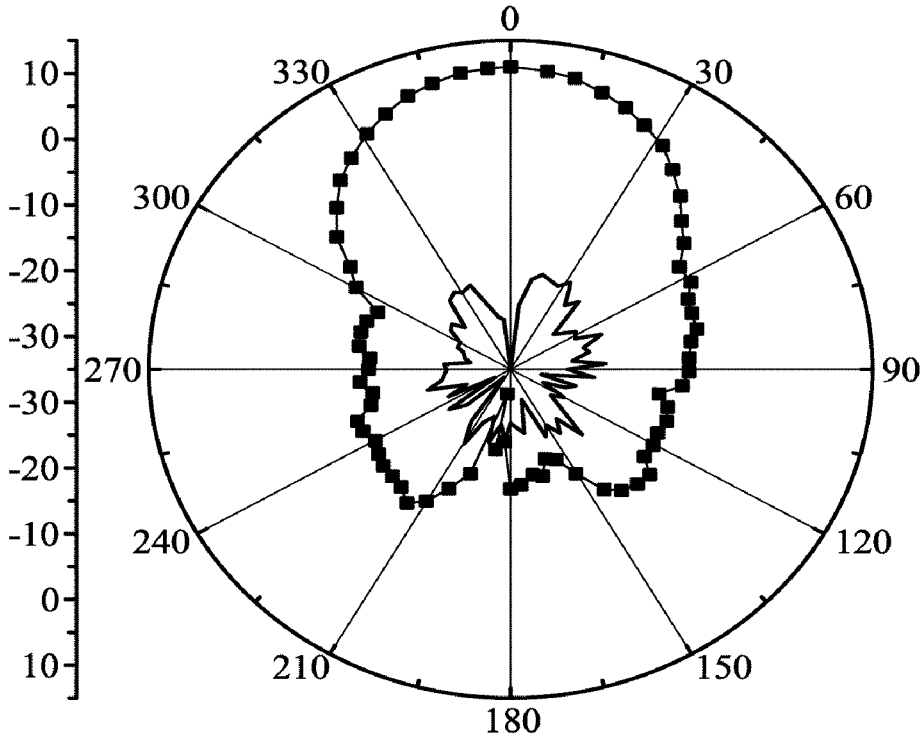
FIG. 4*c* shows the realized gain pattern on XZ plane of the antenna module when transmitting a wireless signal of 5.2 GHz.
Figure 4D:
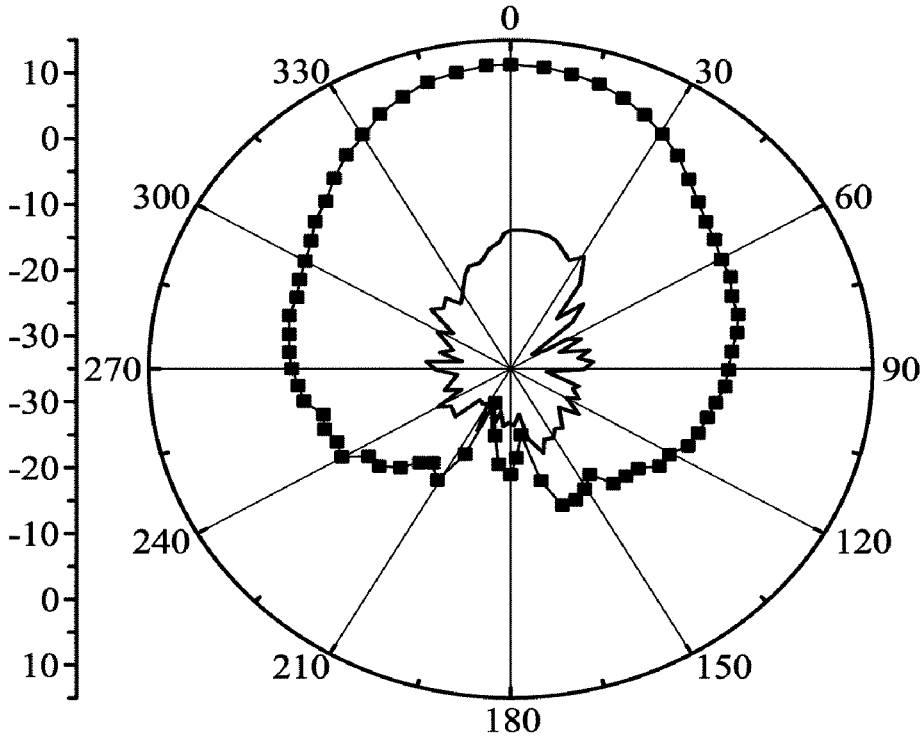
FIG. 4*d* shows the realized gain pattern on YZ plane of the antenna module when transmitting a wireless signal of 5.2 GHz.

FIG. 4*c* shows the realized gain pattern on XZ plane of the antenna module 100 when transmitting a wireless signal of 5.2 GHz. FIG. 4*d* shows the realized gain pattern on YZ plane of the antenna module 100 when transmitting a wireless signal of 5.2 GHz. As shown in FIGS. 4*c* and 4*d*, the antenna module 100 of the embodiment provides improved directivity and cross polarization isolation.

The antenna module of the embodiment provides return loss bandwidth of 23.59%, realized gain of 11.14 dBi and pure polarization. The antenna module of the embodiment is a high bandwidth, high gain, and high cross polarization isolation antenna module.

Figure 5:
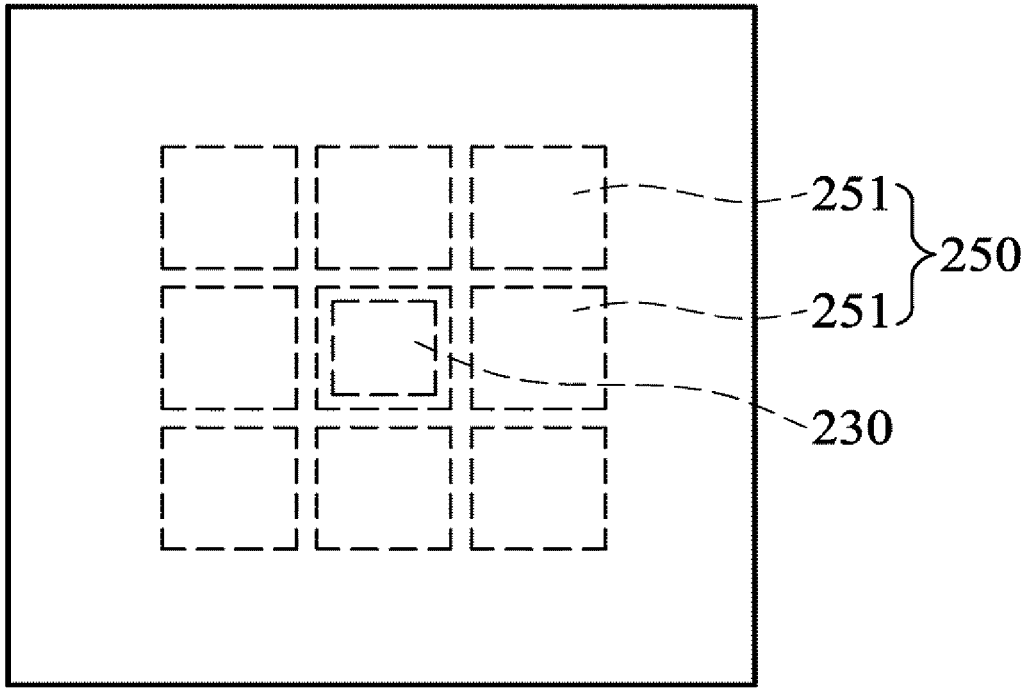
FIG. 5 shows an antenna module of another embodiment of the invention.

FIG. 5 shows an antenna module 200 of another embodiment of the invention, wherein the reflective pattern 250 comprises a plurality of reflective units 251. The reflective units 251 are square, and equidistantly arranged into a phalanx. In this embodiment, the antenna 230 is a Patch Antenna.

The reflective pattern mentioned above is an Electromagnetic Band Gap pattern. The reflective pattern can be modified.

In the embodiment of the invention, the dimension of the reflection gap can be first determined, then the total predetermined phase angle $\Delta$ is achieved according to the dimension of the reflection gap. Then, the reflective pattern and the antenna substrate are designed accordingly. Or, the total predetermined phase angle $\Delta$ is first determined, then the dimension of the reflection gap is achieved according to the total predetermined phase angle $\Delta$. Then, the reflective pattern and the antenna substrate are designed accordingly.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

a reflective superstrate, comprising a first surface and a second surface, wherein the first surface is opposite to the second surface;

an antenna substrate, comprising a third surface and a fourth surface, wherein the third surface is opposite to the fourth surface;

an antenna, disposed on the third surface; and a reflective pattern, formed on the first surface and facing the antenna, wherein a reflection gap is formed between the first surface and the third surface, the reflective pattern provides a first reflection phase angle, the third surface provides a second reflection phase angle, the first reflection phase angle comprises a first determined phase angle $\Delta_1$, the first determined phase angle $\Delta_1$ is not 0°, the first reflection phase angle is about $-(180°-\Delta_1)$, the second reflection phase angle comprises a second determined phase angle $\Delta_2$, the second reflection phase angle is about $-(180°-\Delta_2)$, a dimension of the reflection gap is directly proportional to a total predetermined phase angle $\Delta=\Delta_1+\Delta_2$, and the total predetermined phase angle is between 0°~90°, wherein the reflective pattern comprises a plurality of reflective units, each reflective unit comprises a major axis and a minor axis, the reflective units are equidistantly arranged along a first direction, and the minor axes of the reflective units are parallel to the first direction, wherein the reflective units are arranged into a 4×1 matrix.

2. The antenna module as claimed in claim 1, wherein the total predetermined phase angle is between 0°~60°.

3. The antenna module as claimed in claim 1, wherein the total predetermined phase angle is between 0°~20°.

4. The antenna module as claimed in claim 1, wherein the reflective units are rectangular.

5. The antenna module as claimed in claim 1, wherein a unit gap is formed between contiguous reflective units.

6. The antenna module as claimed in claim 1, wherein the antenna provides a wireless signal, and the wireless signal comprises a major polarization direction and a cross polarization direction, and the first direction is parallel to the major polarization direction.

7. The antenna module as claimed in claim 1, further comprising a ground layer, disposed on the fourth surface.

8. The antenna module as claimed in claim 1, wherein a dielectric material is filled in the reflective gap.

* * * * *